US007073365B2

(12) United States Patent
Geho et al.

(10) Patent No.: US 7,073,365 B2
(45) Date of Patent: Jul. 11, 2006

(54) LINEAR DRIVE METAL FORMING MACHINE

(75) Inventors: Jeffrey Edward Geho, Aurora, IL (US); Harold Cook, Jr., Evergreen, CO (US); Christopher J. Olson, Superior, CO (US); Michael L. Atkinson, Lafayette, CO (US); William Kennedy, Sunnybank Hills (AU)

(73) Assignee: Novelis, Inc., Toronto, Ontario ( * ) Notice: Subject to any disclaimer, the term of this patent is extended or adjusted under 35 U.S.C. 154(b) by 0 days.

(21) Appl. No.: 10/515,552

(22) PCT Filed: May 30, 2003

(86) PCT No.: PCT/CA03/00807

§ 371 (c)(1),
(2), (4) Date: Nov. 23, 2004

(87) PCT Pub. No.: WO03/101642

PCT Pub. Date: Dec. 11, 2003

(65) Prior Publication Data

US 2005/0155404 A1 Jul. 21, 2005

Related U.S. Application Data

(60) Provisional application No. 60/385,865, filed on Jun. 3, 2002.

(51) Int. Cl.
*B21D 41/04* (2006.01)

(52) U.S. Cl. ..... 72/352; 72/370.02; 413/69

(58) Field of Classification Search ..... 72/352, 72/355.2, 355.6, 370.02; 413/69
See application file for complete search history.

(56) References Cited

U.S. PATENT DOCUMENTS

| | | | | |
|---|---|---|---|---|
| 4,392,764 | A * | 7/1983 | Kubis et al. | 413/69 |
| 4,446,714 | A * | 5/1984 | Cvacho | 72/370.02 |
| 4,831,861 | A * | 5/1989 | Hofmann et al. | 72/355.6 |
| 5,355,710 | A | 10/1994 | Diekhoff | |
| 5,755,130 | A | 5/1998 | Meneghin et al. | |
| 6,070,521 | A * | 6/2000 | Otoshi | 100/48 |

FOREIGN PATENT DOCUMENTS

| | | |
|---|---|---|
| GB | 2 310 043 | 8/1997 |

* cited by examiner

*Primary Examiner*—Lowell A. Larson
(74) *Attorney, Agent, or Firm*—RatnerPrestia

(57) ABSTRACT

The invention relates to a method and apparatus for forming metal containers. The method involves introducing a knockout element (110) into the container body through the open end, providing a forming die shaped to reduce the diameter of the sidewall of the container body (100) when the open end of the container body (106) is forced therein to produce a neck portion of reduced diameter on the container body, driving the open end of the container body into the forming die (108), retracting the knockout element through the neck portion as the neck portion is formed, and removing the container body (106) from the forming die (108) and knockout element (110). In the invention, the driving of the open end of the container body into the forming die and/or the movements of the knockout element are carried out under computer numerical control, preferably employing linear motor drives, thereby enabling the driving or movement to be optimized for the container body and the neck portion formed thereon.

15 Claims, 5 Drawing Sheets

LINEAR DRIVE METAL FORMING MACHINE

The entire disclosure of U.S. Provisional Patent Application No. 60/385,865, filed Jun. 3, 2002, is expressly incorporated by reference herein.

TECHNICAL FIELD

The present invention generally pertains to the method and apparatus for producing containers and, more particularly, to die necking of such containers.

BACKGROUND ART

The technology for reducing the open-end portion of a closed end container (necking) has been in existence for over one hundred years. The procedure was originally developed for artillery shells, with a larger diameter shell casing being reduced to retain a smaller diameter projectile. The process by which this is accomplished today is called die necking. The basic concept of necking is to force a typically cylindrical, thin walled metal body or shell at a given diameter and physically push it into a die or series of progressively smaller dies. In this process a reduction in diameter of the open end is realized.

In metal food and beverage cans, the primary purpose for a reduced diameter at the open-end is material savings, and thus realized as cost savings. Because the end panel is of a thickness that is on the order of at least twice the thickness of a typical sidewall, as the diameter of the container is reduced, the amount of material necessary for the end panel is reduced by a greater amount. In certain applications such as aerosol containers, the necking operation is performed to bring the opening to a specific diameter to facilitate a standard size valve assembly and eliminate any secondary adaptor that would otherwise be necessary. A secondary consideration of reducing the diameter of the end of the container is the reduction in the longitudinal stress exerted on the end of the container. As the cap size is reduced, this stress is reduced and the thickness requirement of the end cap is also reduced. The third consideration for diameter reduction is visual. Many aesthetically pleasing shapes can be achieved by necking conventional cylindrical block shapes into tapered geometries and containers that resemble bottles.

There are practical limits on the reduction of the diameter of the material for any given material in any given die. The strength of the can body depends on a number of factors including the Young's modulus and yield stress of the material, the plate thickness and the can diameter. If the practical limit on diameter reduction is exceeded, the material will wrinkle, pleat, pucker or tear at a point inherent to the geometrical characteristics and type of metal being necked.

Conventional die necking of metal containers is accomplished with large-scale machinery that is very difficult to develop the fine tuned properties required to manufacture containers with significant neck length. The development of necking profiles is currently a long, involved, trial and error process that can take months to establish the proper parameters for each necking stage necessary to produce longneck containers. Specifically, current die necker technology uses hard cams to provide motion to pusher and knock-out rams. Key parameters such as cam profile and cam throw must be tested and tweaked with each incremental change in the necking profile. Each time a change is made, the machine must be taken down and modified in a lengthy process to redesign and refit the new cams.

U.S. Pat. No. 5,355,710 discloses a conventional method and apparatus for necking a metal container. The disclosure of this patent is specifically incorporated herein by reference.

DISCLOSURE OF THE INVENTION

The present invention overcomes the disadvantages and limitations of the prior art by providing apparatus and methods for forming metal containers using computer numerical control.

By the term "computer numerical control" as used herein, we mean that a computational device, such as a computer, is used to control the action of a knockout ram and/or a pusher ram in a container die necking apparatus and method.

In its simplest form, the motions of the pusher and the knockout rams are preferably controlled by a prime mover such as a motor, power transmission system, hydraulic system, etc., whose motion is controlled by a computer control system optionally via a displacement feedback loop. In such a case, the computer numerical control systems checks the prescribed path that the user enters in for each ram to the displacement feedback loop and makes adjustments to the prime mover accordingly. The system preferably uses time as its base.

By the term "linear reciprocal prime movers" as used herein we mean a motor or other device that acts in a linear manner to apply force or movement in a desired linear direction without relying on rotary hard cams or the like to advance a knockout element, a container body or a die. Examples of such prime movers include linear drive motors, hydraulic motors, pneumatic motors, or the like. Generally, such prime movers are characterized by greater ranges of linear movement than can be obtained with traditional hard cams. The movement is reciprocal (i.e. can be produced in either direction) and generally highly controllable, despite the application of considerable forces. The most preferred prime movers for use in the present invention are linear drive electric motors.

According to one form of the present invention, there is provided a method of reducing the diameter of a sidewall of a seamless unitary metal container body having a sidewall, an endwall at one end of the sidewall, an open end at an opposite end of the sidewall, and a longitudinal axis extending between the endwall and the open end. The method involves introducing a knockout element into the container body through the open end, providing a forming die shaped to reduce the diameter of the sidewall of the container body when the open end of the container body is forced therein to produce a neck portion of reduced diameter on the container body, driving the open end of the container body into the forming die, retracting the knockout element through the neck portion as the neck portion is formed, and removing the container body from the forming die and knockout element. The method utilizes at least one linear reciprocal prime mover arranged to create movement or force in the direction of the longitudinal axis of the container body to move the knockout element, or to force the container body into the forming die, or both.

According to another form of the present invention, there is provided an apparatus for reducing the diameter of a sidewall of a seamless unitary metal container body having a sidewall, an endwall at one end of the sidewall, an open end at an opposite end of the sidewall, and a longitudinal axis extending between the endwall and the open end. The apparatus comprises a knockout element adapted to be inserted into the container body through the open end, a forming die shaped to reduce the diameter of the sidewall of the container body when the open end of the container body is forced therein to produce a neck portion of reduced diameter on the container body, means for driving the open end of the container body into the forming die, means for retracting the knockout element through the neck portion as the neck portion is formed, and means for removing the container body from the forming die and knockout element. At least one of the means for driving the open end of the container body into the forming die and the means for retracting the knockout element through the neck portion is a linear reciprocal prime mover arranged to create movement or force in the direction of the longitudinal axis of the container body to move the knockout element, or to force the container body into the forming die, or both.

The use of linear prime movers under computer numerical control for manipulating thin gauge metal offers a wide variety of advantages over conventional technology and is not limited to die necking. The present invention provides a high degree of versatility in forming operations and a capability to change profile shaping and a variety of operating parameters in real time. Cam development can be accomplished using the readily adjustable process of the present invention to derive empirical data quickly and efficiently with programmable adjustment of variables such as motion, force and velocity. Stroke length can be adjusted by simply dialing in the desired length on the fly and without shutting down operations as opposed to tearing the machine down, removing the cam that determines thrust, retooling the cam, replacing and testing the new stroke to determine if it matches the intended modification and finally to determine if the modification matches the intended result on the cam profile. A variety of forming variables and associated ratios can be customized and easily adjusted for individual operations and can be controlled independently for each stage in a multiple stage machine. The present invention allows forming operations that require a high degree of variability and precision to be possible. It also allows machinery to be developed which may have been impractical from a development standpoint using current technology.

In a particularly preferred form, the present invention may therefore comprise a method of reducing the diameter of the sidewall at the open end of a seamless unitary metal container body having a sidewall disposed about a longitudinal axis and a unitary endwall at one longitudinal end of the sidewall opposite to the open end comprising: placing the container body with the endwall in communication with a drive segment and the sidewall in communication with a forming segment having a fixed position forming die of curvilinear configuration in longitudinal cross section and located to form a juncture with the original diameter of the sidewall and progressing with further reduction in diameter toward the open end of the container body; driving a knockout ram with a first linear drive motor that produces a reciprocal motion in the longitudinal axis relative to the container; drawing a knockout that is connected to the knockout ram, the knockout disposed to engage an interior surface of the open end of the container and having a substantially uniform reduced diameter corresponding to the reduction in diameter at the curvilinear configuration of the forming die; extending the knockout longitudinally with the first linear motor to a depth within the open end of the container body beyond the juncture with the original diameter of the sidewall; driving a pusher ram with a second linear drive motor producing a reciprocal motion in the longitudinal axis relative to the container; engaging an exterior surface of the endwall of the container with a pusher pad that is driven by the pusher ram; transmitting a linear force by the second linear motor through the pusher ram to the pusher pad to the endwall of the metal container to the sidewall of the metal container thus forcing the sidewall into the curvilinear portion of the forming die; retracting the knockout while the linear force is being applied to the metal container during the die forming process; reducing the diameter of the sidewall that is contiguous to the open end of the unitary can body as the container reaches an endpoint of the curvilinear configuration within the forming die.

In another particularly preferred form, the present invention may also comprise an apparatus for reducing the diameter of a sidewall at the open end of a seamless unitary container body, the sidewall disposed about a longitudinal axis and a unitary endwall at one longitudinal end of the sidewall opposite to the open end comprising: a fixed position forming die of curvilinear configuration in longitudinal cross section and located to form a juncture with the diameter of the sidewall and progressing with further reduction in diameter toward the open end of the container body; a first linear drive motor producing a reciprocal motion in the longitudinal axis relative to the container; a knockout of-substantially uniform reduced diameter corresponding to the reduction in diameter at the curvilinear configuration of the forming die, the knockout extending longitudinally from a position outside of the open end of the container to a depth within the container body beyond the juncture with the diameter of the sidewall; a second linear drive motor producing a reciprocal motion in the longitudinal axis relative to the container; a pusher ram connected to a pusher pad which engages the exterior surface of the endwall of the container, the second linear drive motor which transmits a linear force through the pusher ram to the pusher pad to the endwall of the metal container to the sidewall of the metal container thus forcing the sidewall into the curvilinear portion of the forming die, the first linear drive motor able to retract the knockout while the linear force is being applied to the metal container by the second linear drive motor during the die forming process.

In yet another particularly preferred form, the present invention may also comprise an apparatus for the development of metal container manufacturing equipment comprising: an apparatus for reducing the diameter of a sidewall at the open end of a seamless unitary container body, the sidewall disposed about a longitudinal axis and a unitary endwall at one longitudinal end of the sidewall opposite to the open end comprising; a fixed position forming die of curvilinear configuration in longitudinal cross section and located to form a juncture with the diameter of the sidewall and progressing with further reduction in diameter toward the open end of the container body; a first linear drive motor producing a reciprocal motion in the longitudinal axis relative to the container; a knockout of substantially uniform reduced diameter corresponding to the reduction in diameter at the curvilinear configuration of the forming die, the knockout extending longitudinally from a position outside of the open end of the container to a depth within the container body beyond the juncture with the diameter of the sidewall; a second linear drive motor producing a reciprocal motion in the longitudinal axis relative to the container; a pusher ram connected to a pusher pad which engages the exterior surface of the endwall of the container, the second linear drive motor which transmits a linear force through the pusher ram to the pusher pad to the endwall of the metal container to the sidewall of the metal container thus forcing the sidewall into the curvilinear portion of the forming die, the first linear drive motor able to retract the knockout while the linear force is being applied to the metal container by the second linear drive motor during the die forming process.

The present invention has numerous advantages over prior art. These include a high degree of versatility in forming operations and a capability to change operating parameters on the fly. Variables such as motion, force and velocity are programmable and highly adjustable at anytime during the forming stroke. In combination with this variability the present invention allows for alteration of the programming in real time, and thus, modifications to the metal forming can be accomplished rapidly and without shutting down or retooling the production equipment. This real time alteration of metal forming allows the apparatus to be utilized as a development tool to set manufacturing parameters on production machines that do not possess such variability.

The forming variables and associated ratios can be customized and easily adjusted for individual operations and can be controlled independently for each stage in a multiple stage machine. This can be accomplished on the "push" side of the forming operation and also on the "pull side" with the same or different forces. These additional motions can be used for multiple necking stages or any other operation that require linear motion such as expandable mandrels or for performance of other operations (i.e., bottom piercing etc.).

Numerous advantages and features of the present invention will become readily apparent from the following detailed description of the invention and the embodiment thereof, from the claims and from the accompanying drawings in which details of the invention are fully and completely disclosed as a part of this specification.

BEST MODES FOR CARRYING OUT THE INVENTION

Figure 1:
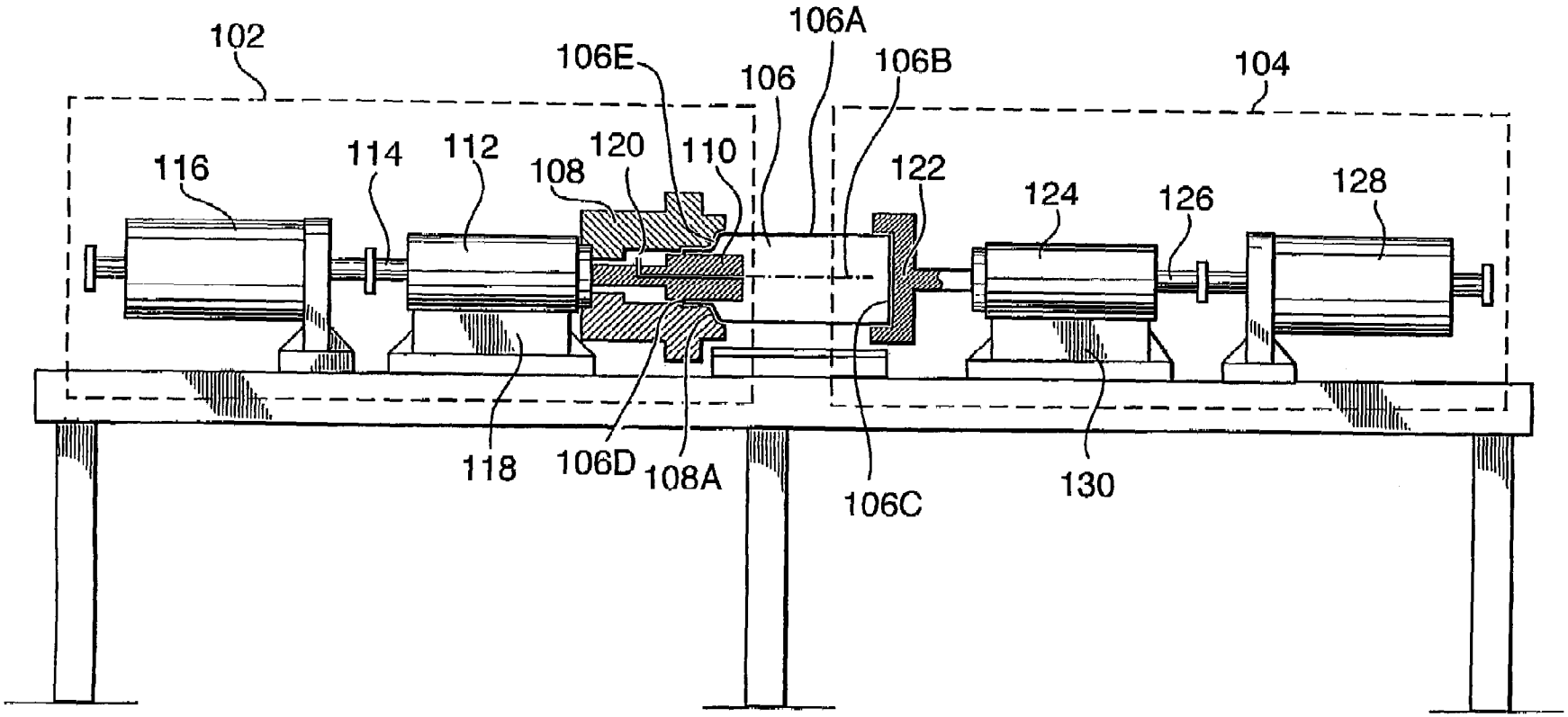
FIG. 1 is a schematic illustration of one embodiment of the overall system of the present invention.

FIG. 1 of the drawings discloses a schematic illustration of one embodiment of the overall system and apparatus of the present invention. As shown in FIG. 1, the apparatus can be viewed as including a forming segment 102 and a drive segment 104 (illustrated within dotted lines) that together carry out operations on a seamless unitary metal container body 106 to achieve a reduction in the diameter of the sidewall 106A of the body, an operation also known as die necking. Die necking is initiated by the stroke of a first linear motor 116, which is preferably a linear drive motor, acting as a prime mover. The first linear motor 116 generates an inwardly directed longitudinal force on a knockout ram 114 that is transmitted to a knockout element 110 (often referred to simply as a "knockout"). The knockout ram 114 is secured by a knockout ram bushing/die retainer 112 which allows the knockout ram to experience linear motion in the direction of the longitudinal axis 106B of the metal container 106. The ram bushing/die retainer 112 also holds and retains a forming die 108 through which the knockout ram 114 and knockout element 110 extend. A similar second linear motor 128 is provided in the drive segment 104 and it generates an inwardly directed linear force on a pusher ram 126 that extends through a pusher ram bushing 124 to a pusher pad 122. The pusher ram bushing 124 secures the pusher ram 126 and allows the pusher ram to experience linear motion in the direction of the longitudinal axis 106 B of the container body 106. The pusher pad consequently exerts force on a closed end wall 106C of the container body 106.

In order to initiate a die necking operation, the first linear motor 116 is initiated to extend and insert the knockout element 110 inside the open-ended metal container 106 beyond a point where a reduction in the diameter of the sidewall will occur. Once the knockout element 110 is in place, the second linear motor 128 transmits a longitudinal force through pusher ram 126 to pusher pad 122. The metal container body 106 is consequently driven into and contacts a shaped inner forming surface 108A of the forming die 108 from the receiver end. Air (or other gas) under pressure is introduced into the interior of the container body through a channel 120 in knockout element 110 to pressurize the container body 106 in order to maintain its structural integrity in the radial direction during the necking operation. Concurrently, sufficient linear force is transmitted from the drive segment 104 to allow the open end 106D of the container body 106 to conform to the shape of the inner surface 108A of the forming die 108 to form a neck portion 106E while the first linear motor 116 retracts the knockout element 110 out of the container body 106 through the neck portion 106E as it is formed in order to maintain support on the inside diameter of the sidewall and to assist in drawing the metal in a longitudinal direction. As the pusher pad 122 reaches the maximum stroke, as determined by the second linear motor 128, the complete withdrawal of the knockout element 110 and the air pressure within the container body 106 serve to release the container body 106 from the forming segment 102 of the apparatus.

Figure 2:
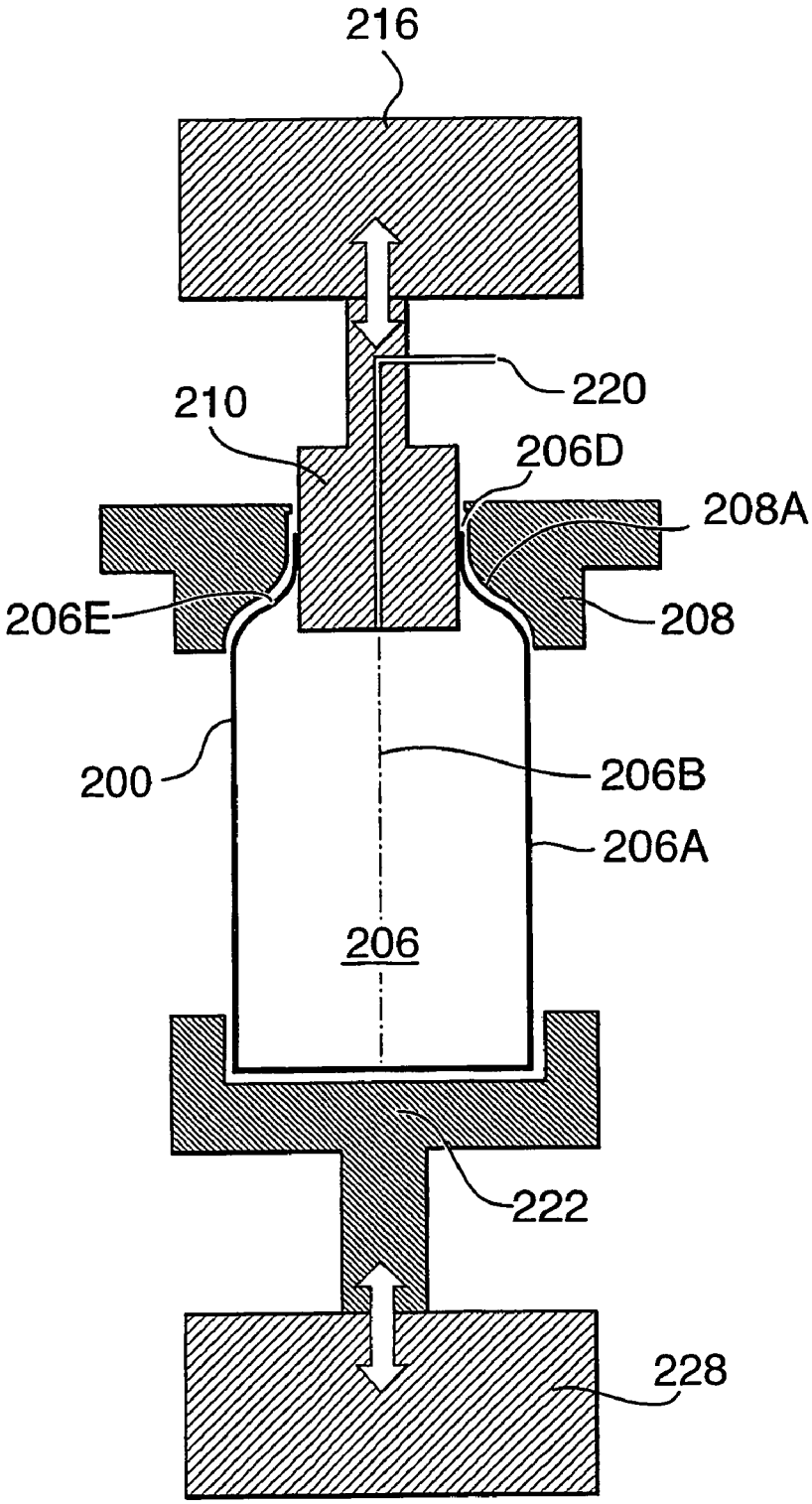
FIG. 2 is a schematic illustration of one embodiment of a die necking operation of a thin wall cylindrical beverage container.

FIG. 2 of the drawings discloses a more detailed schematic illustration of one embodiment of the die necking operation of the present invention. As shown in FIG. 2, the die necking (reduction of the diameter) of a sidewall 206A of a seamless unitary metal container body 206 is initiated by the stroke of a first linear motor 216. The first linear motor 216 generates a longitudinal force that is transmitted to a knockout element 210. The knockout element 210 is extended and inserted inside the open-ended metal container body 206 beyond a point where a reduction in the diameter of the sidewall will occur. Once the knockout element 210 is in place, a second linear motor 228 transmits a longitudinal force to a pusher pad 222.

An open end 206D of the metal container body 206 is driven into and contacts the inner forming surface 208A of a forming die 208 from the receiver end. Air under pressure is introduced into the interior of the container body 206 through a channel 220 passing through the knockout element 210 and is utilized to pressurize the container body 206 to maintain its structural integrity in the radial direction during the necking operation. Concurrently, sufficient linear force is transmitted from the second linear motor 228 to allow the container body 206 to conform to the shape of the inner surface 208A of the forming die 208 while the first linear motor 216 retracts the knockout 210 out of the container body 206 to maintain support on the inside diameter of the sidewall in the neck portion 206E as it is formed, to assist in drawing the metal in a longitudinal direction and to prevent pleating of the metal container 206 in the neck portion. After the pusher pad 222 reaches the maximum stroke, as determined by the second linear motor 228, the knockout element and the air pressure inside the container body push the can body from the forming die. This is possible as the pusher pad commences to move away from the forming die. The knockout element is reversed during this step in order to push the can from the die.

As detailed in FIGS. 1 and 2, these die necking processes reduce the container diameter by a few millimeters in each operation. If a greater reduction is attempted, the material undergoes a hoop buckling failure known as "pleating." The use of the knockout element helps to prevent this failure. The profiles of the forming die and the knockout element match each other, so that the gap between them is about 1.03 to 1.5 times the material thickness. This is sufficient to permit the material to pass through with slight thickening, but will not permit the material to pleat.

By using the type of apparatus disclosed herein, and exhibiting a great amount of control on the speeds and forces necessary to produce the container, the problem of pleating can be eliminated, and far greater reductions in diameter are possible. The achievable reduction is still limited, however, by the force that can be applied to the metal container.

Figure 3:
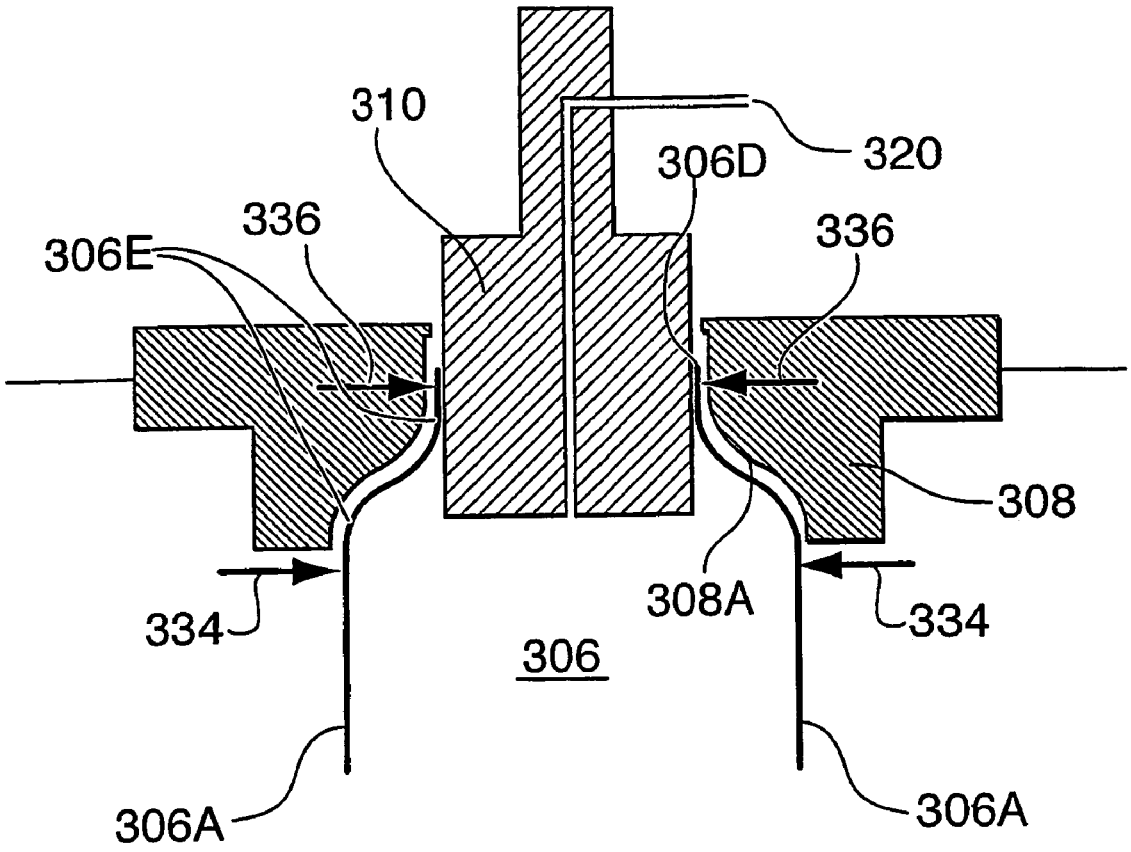
FIG. 3 is a detailed schematic illustration of a die necking of the diameter of the sidewall of a seamless unitary metal container body.

FIG. 3 of the drawings discloses a more detailed schematic illustration of one embodiment of the die necking operation on the sidewall of a seamless unitary metal container body. As shown in FIG. 3, a metal container 306 with an initial container diameter 334 is pushed into a forming die 308 and applied force from a linear motor (not shown) is transmitted through the body of the container by the container side wall 306A. With this application of linear force, the container sidewall 306A conforms to the shape of the die forming surface 308A and is prevented from pleating by the knockout element 310. The container sidewall 306A is shaped in the necked portion of the container 306E from an initial container diameter 334 to a final container diameter 336. The maximum force that can be applied to form the necked portion of the container 306E is limited by the strength of the container body 306. If the necking force exceeds the strength of the container body then the necking will cease and the container will be crushed.

The present invention allows substantial variability not only on the "push" side of the forming operation but also on the "pull" side. The pull side is driven by a linear motor that retracts or removes the knockout element 310 from the metal container 306 as the container sidewall 306A conforms to the die forming surface 308A. The pull of the knockout element 310 during the push phase of the forming operation assists in drawing the open end 306D of the container sidewall 306A into the forming die 308 and in maintaining proper wall thickness and shape over the necked portion of the container 306E. It is the force and the velocity of the push and pull, as well as their ratios to one another, that determine the ability and precision with which the apparatus is able to shape the metal container body 306. These push/pull force or velocity ratios and discrete values can be varied individually for each necking stage as well as through an individual forming stroke. Because metals can only be cold worked to a limited extent based on their inherent physical properties, this process is usually performed as a number of repeated die necking sequences. This produces a more smooth and tapered neck on the container. After undergoing an initial forming operation in an original die, the metal container is subjected to a series of additional forming operations (possibly as many as 50 or so) using dies with increasingly aggressive curves, each of the successive die necking operations partially overlaps and reforms only a part of the previously formed portion to produce a smooth tapered neck of desired length. The necked portion may increase the fill capacity of the container and may also contain walls which have been thickened in the necking process, and therefore, provide greater crush strength in the necked area independently of the profile.

Figure 4:
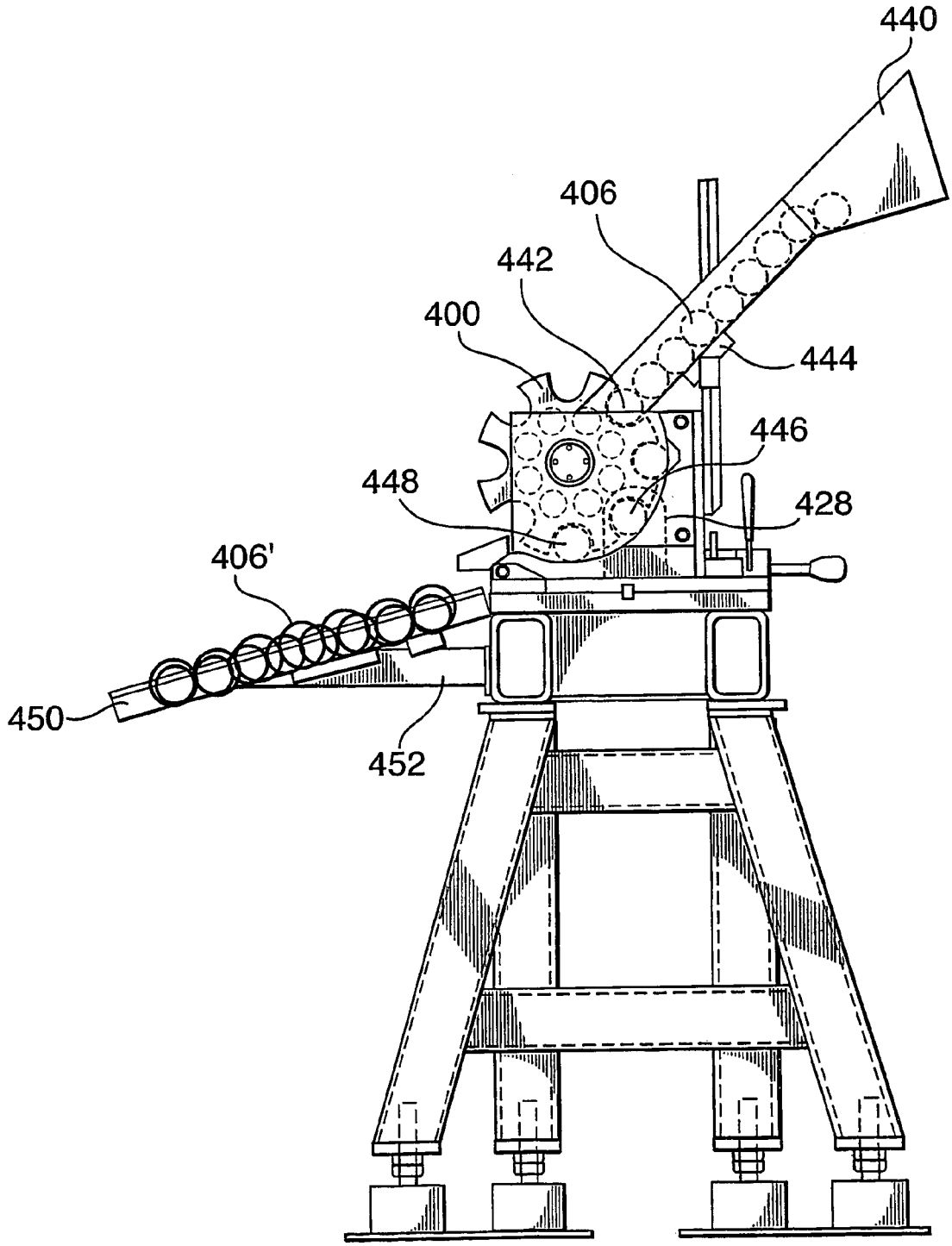
FIG. 4 is a lateral view schematic illustration of one embodiment of a die necking operation of a thin wall cylindrical beverage container.

FIG. 4 of the drawings discloses a detailed schematic illustration of one embodiment of the die necking operation of the present invention. As shown in the lateral view of FIG. 4, a star wheel assembly 400 is utilized to facilitate the automated insertion and extraction of metal containers 406 from the metal forming apparatus. Pre-necked containers 406 are loaded into a chute 440 which is supported by the chute mount 444. The containers are stacked and oriented side-to-side awaiting insertion to the star wheel assembly 400 at a star wheel insertion point 442. Upon each cycle of a linear motor 428 that produces a die necking operation on a metal container, the star wheel assembly indexes by rotating clockwise 45 degrees (in this particular embodiment). The die necking operation as described in the previous drawings in performed at a star wheel necking point 446 where the metal container aligns longitudinally with the linear motors and forming die assembly (not shown) as previously described. After undergoing the die necking operation at star wheel necking point 446, the necked metal container is indexed within the star wheel assembly 400 and continues in a clockwise manner to a point where it is removed from the star wheel assembly 400 at a star wheel extraction point 448. The finished container 406' is collected in a pick up gutter 450 which is supported by a pick up gutter mount 452.

By utilizing linear motors as in the above examples, advantages over conventional methods and devices are realized. The disclosed invention allows the relative motion of the pusher and knockout element to be capable of a highly variable velocity (push/pull) ratio throughout the neck forming operation. In this manner the velocity ratio (push/pull) can be varied for the individual necking stages and through an individual stroke. By including a microprocessor driven controller, the forces, velocities and respective ratios can all be independently programmable and highly adjustable at anytime during the forming stroke.

By using an apparatus as detailed in FIG. 1, four independent motions relative to a fixed die position are possible (two on the pusher side and two on the knockout side). Forming operations can be performed on both ends of the motors stroke or the same operation can be performed at either end with the same or different forces. These additional motions can be used for multiple necking stages or any other operation that require linear motion such as expandable mandrels or for performance of other operations (i.e., bottom piercing etc.). As with the primary container forming motions, these additional motions are also programmable and highly adjustable at anytime during the forming stroke.

The forming forces described within the aforementioned examples are also programmable and highly adjustable anytime during the forming stroke. They can be customized and adjusted for individual operations and adjusted independently for each stage in a multiple stage machine. Connecting linear motors in tandem can also increase these forces to nearly any extent necessary.

Since the aforementioned method and apparatus have the advantage of being highly versatile in forming operations, with parameters such as motion, force and velocity capable of being changed on as an operation proceeds, the system is highly applicable in the area of container manufacture development. Modifications to the metal forming can be accomplished rapidly and without shutting down or retooling the production equipment. Container profiles can be developed quickly and easily using these alterations and optimization features. This allows the invention to be utilized as a laboratory or development tool to set manufacturing parameters on production machines containing less sophistication, variability and cost for purposes of mass production.

The apparatus of the present invention is preferably controlled by a computer control system, optionally by a displacement feedback loop. The computer may be used to control the prime movers acting on the pusher and knockout rams, and optionally the supply of pressurized fluid to the interior of the container body. Thus, the computer may be used to control such variables as the stroke length of the knockout ram and/or the pusher ram, the velocity ratios of the rams, the strip air timing, pressure and pressurization profile, and adjustments for different neck lengths (e.g. by adjusting pin height). Such adjustments may be made by modifications of a computer control program (computer numerical control) via a variety of available user interfaces.

Figure 5:
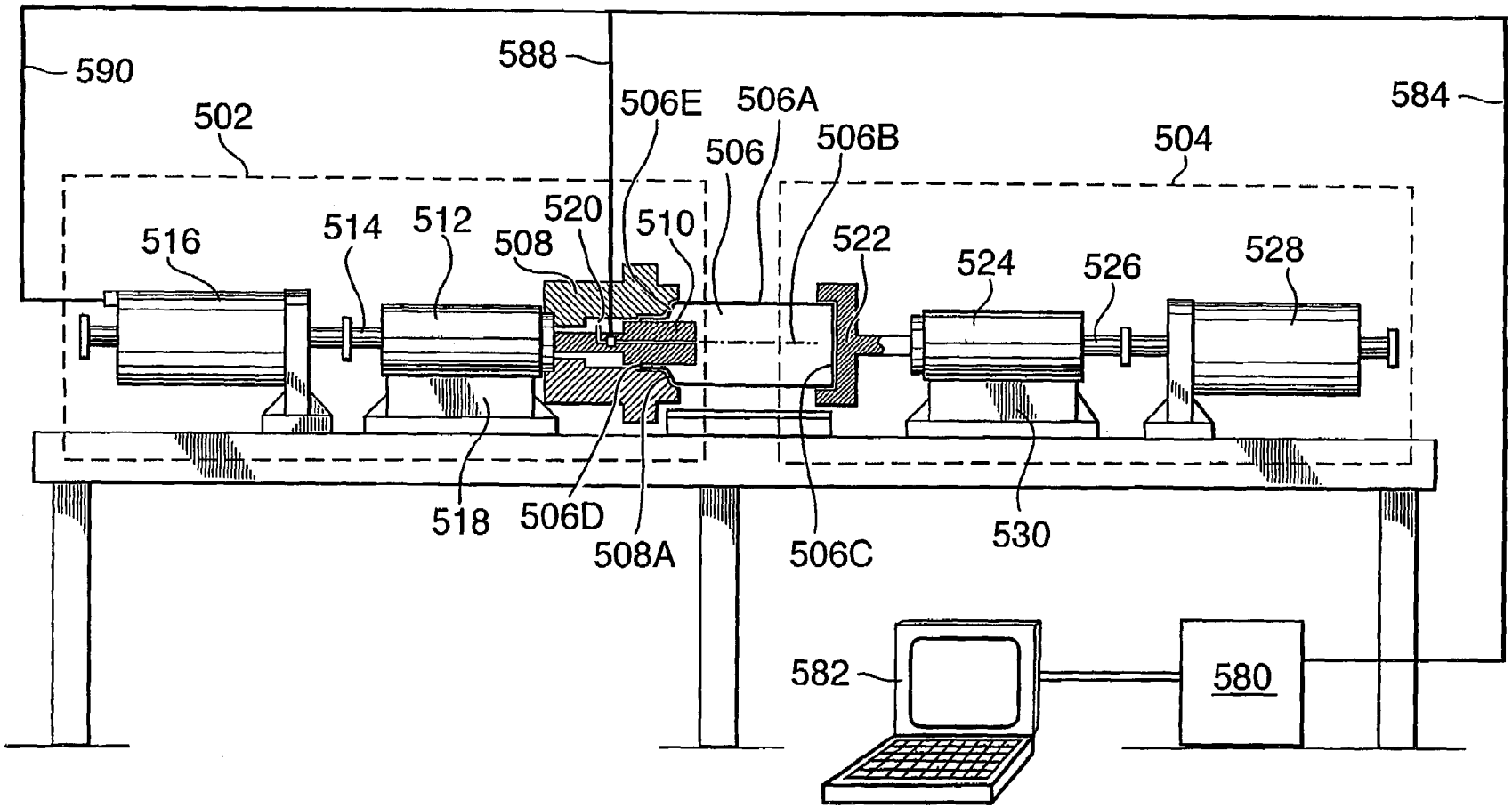
FIG. 5 is an illustration similar to FIG. 1, but showing a computer numerical controller connected to the die necking apparatus.

A simplified example of such a system is illustrated in FIG. 5. This shows apparatus similar to that of FIG. 1, with the same reference numerals used to indicate the same elements, except that the numerals begin with a "5" rather than "1". FIG. 5 additionally shows a computer controller 580 that may be accessed via a monitor and keyboard arrangement 582. The computer controller is connected via wires to actuators controlling the motors 528 and 516 and the air supply via channel 520. The apparatus includes a displacement feedback loop (not shown), i.e. means for measuring the displacement (or other characteristics) of the knockout and pusher rams and for returning this information to the computer controller 580 so that the information can be compared with the instructions programmed into the controller. The computer controller can therefore check the prescribed path that a user enters in for each ram to the displacement feedback loop and makes adjustment to the prime movers accordingly. The system preferably uses time as its base. Alternatively, the system may use a desired velocity ratio (i.e. the ratio of the knockout velocity relative to the pusher velocity), which may be held constant or variable, and then the computer controller may determine what path the knockout element or pusher should follow to satisfy the velocity ratio.

A further alternative way of establishing differential motion between the pusher and knockout (i.e. similar to the velocity ratio), which may help to optimize the process, is to measure the pusher load or the load that the prime mover sees on the pusher side. The load is then used in the feedback loop to control the acceleration, velocity, and/or the displacement ratios between the pusher and knockout rams so that the machine minimizes the load, thus minimizing the load placed on the container being necked. It may be necessary to compensate for the load due to the air pressure that is used to strip the container body from the forming die in the apparatus. Just before the container is necked, the container is filled with air at pressure greater than atmospheric pressure. This compensation may be accomplished by using the load in the feedback loop only during the neck forming periods of the machine cycle and/or by measuring the pressure load throughout the cycle and accounting for it.

The feed back loop mentioned above may be used to minimize the load that is applied to a container body during the necking operation. Thus, the retraction of the knockout element can be detected and controlled to reduce the force necessary to cause the necking as the container body is forced into the forming die. The knockout element helps to draw the container body into the forming die as it shapes the necked portion, thus enabling the pushing force on the container body to be reduced. The computer controller can be used to sense and control these respective forces to apply the minimum forces required to achieve proper necking.

Also adjustable is the "pin height". This is the distance between the pusher pad and the shaping die and it can be adjusted using the computer controller to control the prime movers using the displacement feedback loops to provide the desired setting input by the user. A locking system may then be used to "fix" the adjustment to ensure that it does not change during the course of operation. Thus container bodies of differing size may be accommodated by equipment of one kind. A variation of this is to use the computer control system that adjusts the pin height to also move during the necking process to provide velocity ratios other than those inherently built into a hard cam system.

As far as controlling the air pressure to the container body during and after necking is concerned, the computer controller may be used to slow down the flow of air to the interior of the container body when a certain pressure has been reached. Air slowly leaks from the container around the knockout element so a continual flow or air into the container body is required to compensate for this. However, if an excessive flow of air is maintained after optimal pressure has been reached, more air merely leaks around the knockout element and costs are increased by the resulting air flow losses. By providing a pressure sensor in the container body, e.g. on the knockout element, the computer can be notified when the pressure has reached the optimum value and a valve may be adjusted by the computer controller to minimize the air flow necessary to maintain the desired pressure.

The way in which the air flow is controlled during the necking operation is referred to as strip air timing. As well as optimizing strip air timing for a particular container body, the computer controller can be used to adjust the strip air timing when adjusting neck profiles in order to provide the air flow at the right time. The pressure may also be optimized to allow for the buildup of air so that maximum pressure is reached when needed in order to reduce neck defects and provide the force necessary to strip the container body from the forming die.

Ideally, therefore, the apparatus of the present invention has infinitely adjustable pusher and knockout ram motion, infinitely adjustable velocity ratios, infinitely adjustable strip air timing, pressure and pressurization profiles, simple adjustments for different neck lengths (by adjusting stroke and pin heights), with simple adjustment for containers of different heights (by adjusting the pin height). These adjustments are made to take effect via modifications of the computer control program and are made possible by using at least one linear reciprocal and controllable prime mover.

Although the apparatus of the present invention preferably has infinitely adjustable prime movers in both the forming segment and the drive segment, this is not essential. A conventional hard cam arrangement may be provided in one of these segments with a reciprocal prime mover in the other. The term "hard cam" refers to a physical cam (hardware as opposed to software) of the conventional kind that, upon rotation, causes a longitudinal movement of the pusher ram or knockout ram. The hard cam may move the pusher or knockout ram that has a stroke length sufficient to be able to neck container bodies with neck lengths, container heights and diameters that would be within the expected range, while using a computer controlled reciprocal linear prime mover on the other ram.

Indeed, hard cams may be used to move both the pusher and the knockout rams, providing stroke lengths sufficient to neck containers with neck lengths, can heights and diameters that would be within an expected range. Then, a computer controlled reciprocal linear prime mover may be used to control the pin height between the pusher side relative to the die/knockout side of the machine and to lock the distances in so that there would be no movement during necking. Alternatively, the separation between the two sides need not be locked relative to one another, using the computer controlled system to obtain the effect of different velocity ratios between the pusher and knockout rams.

As a further alternative, it is possible, instead of pushing the container body into the shaping die, to hold the can stationary and to push the shaping die onto the container body to form a neck portion. The use of a knockout element is still be required in the same way. The motions of the die and knockout rams may be coordinated for optimal results. A linear prime mover is used to control the motion of the shaping die in such cases.

As a still further alternative, the invention may be used to form a flexible neck profile machine. Where one set of tooling is designed in such a way that it may be used to neck containers with vastly different neck profiles without the need of all new tooling. In this case, only a few new tools would be required most likely at the beginning and ending stages of the neck tooling progression.

The foregoing description of the invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications that are suited to the particular use contemplated. It is intended that the appended claims be construed to include other alternative embodiments of the invention except insofar as limited by the prior art.

Although the following claims define particular combinations of features, it should be kept in mind that other combinations of such features are possible, and all such possible combinations of features form part of the present invention.

The invention claimed is:

1. A method of reducing the diameter of a sidewall of a seamless unitary metal container body having a sidewall, an endwall at one end of the sidewall, an open end at an opposite end of the sidewall, and a longitudinal axis extending between the endwall and the open end, which method comprises: introducing a knockout element into the container body through the open end, providing a forming die shaped to reduce the diameter of the sidewall of the container body when the open end of the container body is forced therein to produce a neck portion of reduced diameter on the container body, driving the open end of the container body into the forming die, retracting the knockout element through the neck portion as the neck portion is formed, and removing the container body from the forming die and knockout element; wherein at least one of the driving of the open end of the container body into the forming die and the movements of the knockout element are carried out by at least one linear reciprocal prime mover arranged to create movement and force in the direction of the longitudinal axis of the container body under computer numerical control, thereby enabling at least one of said driving and movement to be optimized for said container body and said neck portion formed thereon.

2. A method according to claim 1, wherein the linear reciprocal prime mover comprises a linear motor drive.

3. A method according to claim 1, wherein said at least one linear reciprocal prime mover is adjustable with respect to at least one of the extent or pattern of movement of the knockout element and the forcing of the container body into the forming die, thereby enabling the method to be carried out on container bodies of different kinds by suitably adjusting said at least one reciprocal prime mover to accommodate said different kinds of container bodies.

4. A method according to claim 1, wherein two linear reciprocal prime movers are provided, one to move the knockout element and a second to force the container body into the forming die.

5. A method according to claim 1, wherein a fluid is introduced under pressure into the container body as the neck portion is formed to provide rigidity to the container body and to assist with removing of the container body from the forming die.

6. A method according to claim 5, wherein flow rate and pressure of said fluid in the container body is provided under computer numerical control as said method proceeds to minimize loss of fluid from the container body.

7. An apparatus for reducing the diameter of a sidewall of a seamless unitary metal container body having a sidewall, an endwall at one end of the sidewall, an open end at an opposite end of the sidewall, and a longitudinal axis extending between the endwall and the open end, which apparatus comprises: a knockout element adapted to be inserted into the container body through the open end, a forming die shaped to reduce the diameter of the sidewall of the container body when the open end of the container body is forced therein to produce a neck portion of reduced diameter on the container body, means for driving the open end of the container body into the forming die, means for moving and retracting the knockout element through the neck portion as the neck portion is formed, and means for removing the container body from the forming die and knockout element, at least one of said means for driving the open end of the container body into the forming die and said means for moving and retracting the knockout element through the neck portion as the neck portion is formed being a linear reciprocal prime mover under computer numerical control arranged to create movement and force in the direction of the longitudinal axis of the container body.

8. An apparatus according to claim 7, wherein said at least one linear reciprocal prime mover is adjustable with respect to at least one of the extent or pattern of reciprocation of the knockout element and the forcing of the container body into the forming die, thereby enabling the apparatus to be used with container bodies of different kinds by suitably adjusting said at least one reciprocal prime mover to accommodate said different kinds of container bodies.

9. An apparatus according to claim 7, wherein said linear reciprocal prime mover comprises a linear motor drive under said computer numerical control.

10. An apparatus according to claim 7, wherein two linear reciprocal prime movers are provided, one to move the knockout element and a second to force the container body into the forming die.

11. An apparatus according to claim 7, wherein said at least one reciprocal linear prime mover acts on said container body to force said container body into said forming die.

12. An apparatus according to claim 7, wherein said at least one reciprocal linear prime mover acts on said forming die to force said container body into said die.

13. An apparatus according to claim 7, wherein a supply of fluid is provided to introduce fluid under pressure into the container body as the neck portion is formed to provide rigidity to the container body and to assist with removing of the container body from the forming die.

14. An apparatus according to claim 13, wherein a computer controller is provided to vary a flow rate and pressure of said fluid into the container body in order to minimize loss of fluid from the container body.

15. An apparatus according to claim 7, wherein said at least one linear reciprocal prime mover is a linear electric motor, a hydraulic motor or a pneumatic motor.

* * * * *